United States Patent [19]

Olivieri

[11] 4,011,634

[45] Mar. 15, 1977

[54] LACING DEVICE FOR SKI BOOTS

[76] Inventor: Icaro Olivieri, 10, Via Feltrina Nord, Montebelluna, Italy, 31044

[22] Filed: June 25, 1976

[21] Appl. No.: 699,682

[30] Foreign Application Priority Data

July 4, 1975 Italy ..... 12686/75

[52] U.S. Cl. ..... 24/70 SK; 36/50

[51] Int. Cl.[2] ..... A43C 11/00; A43B 11/00

[58] Field of Search ..... 36/117, 50; 24/70 SK

[56] References Cited

UNITED STATES PATENTS

| | | | |
|---|---|---|---|
| 3,333,302 | 8/1967 | Klima | 24/70 SK |
| 3,654,670 | 4/1972 | Baso | 36/117 |
| 3,956,796 | 5/1976 | Guolo | 24/70 SK |

*Primary Examiner*—Patrick D. Lawson
*Attorney, Agent, or Firm*—Marvin Feldman

[57] ABSTRACT

The lacing device for ski boots comprises a hooked lever-like member which cooperates with a ring-like member. Each lacing member is hingedly mounted on a carrier plate which can be slidably fitted on a slide guide element provided on the flap of the ski boot upper. Each slide guide element presents a plurality of notches which can be engaged by a locking tooth provided on a locking lever which is hingedly mounted on the carrier plate. It is therefore possible to adjust the position of the carrier plate, and of the lacing member carried thereby, on the slide guide element, and, after having adjusted said position, to lock the carrier plate so as to avoid any accidental displacement of same.

6 Claims, 5 Drawing Figures

LACING DEVICE FOR SKI BOOTS

BACKGROUND AND SUMMARY OF THE INVENTION

The present invention relates to a lacing device for ski boots, and more particularly to novel means for anchoring the two members composing the said lacing device to the ski boot.

The modern ski boots are provided with a number of lacing devices each comprising a hooked lever-like member cooperating with a ring-like member. The said members are fastened to base plates, which in turn are secured to the ski boot upper, at both sides of the longitudinal opening formed in the upper, usually by means of rivets.

In the event that one of the said devices becomes irreparably damaged, its substitution is very difficult, and may be accomplished only by a skilled person with the aid of special tools and with the serious risk of damaging the ski boot.

In the U.S. Pat. No. 3,956,796 to GUOLO (patented May 18, 1976) there is shown a lacing device in which the lacing members are mounted each on a base plate which may be assembled and removed with a sliding fit on a slide guide formed on the ski boot upper. The arrangement according to the mentioned U.S. patent solves the problem of the possibility of easy removal of the lacing member to be substituted, but presents two inconveniences deriving from the fact that the lacing members may be accidentally removed and lost when the lacing device is not closed, and that there is no possibility of adjustment of the distance of the lacing members with respect to the longitudinal opening defined in the upper by the flaps, that is of the distance between the two cooperating lacing members of each lacing device.

The lacing device for ski boots according to the invention is characterized by the feature that its components, or lacing members, can be easily mounted and disassembled (but not accidentally) from the ski boot upper, and that they are secured on the ski boot with the possibility of adjustment of their distance with respect to the longitudinal opening in the ski boot, that is of the distance between the two cooperating lacing members of each lacing device, in a very simple manner, without the need of special tools, by the individual skier at the moment of the use of the ski boot.

The lacing device according to the invention is characterized by the provision, on the ski boot upper, of a slide guide element presenting a series of notches longitudinally arranged on same. The lacing member (either hooked lever-like or cooperating ring-like lacing member) is mounted on a carrier plate which can be slidingly fitted onto the mentioned slide guide element. The carrier plate is provided with a locking lever presenting a locking tooth which can be pressed and inserted into the desired notch thus locking the carrier plate, and the lacing member mounted on it, on the desired position.

BRIEF DESCRIPTION OF THE DRAWINGS

Further objects and advantages of the lacing device according to the invention will appear evident from the following specification made with reference to the accompanying drawings, in which.

DESCRIPTION OF THE PREFERRED EMBODIMENT

Figure 1:
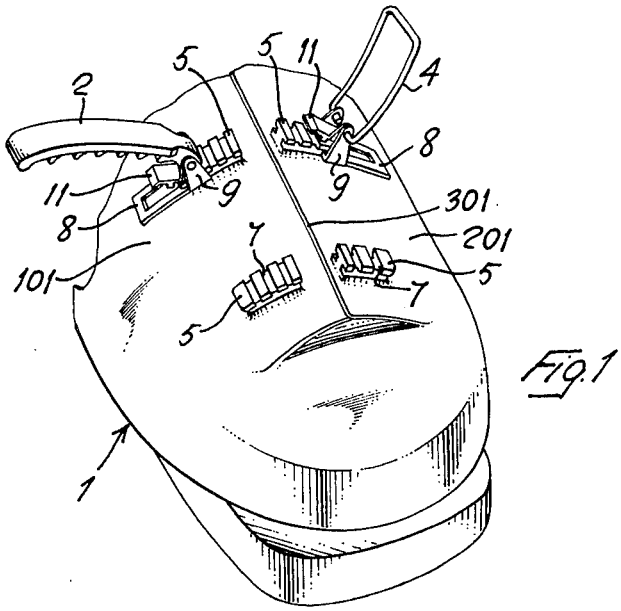
FIG. 1 is a perspective view of the broken away front portion of a ski boot provided with a lacing device according to the invention.

With reference to the drawings, reference numeral 1 indicates a ski boot made of plastic material. The ski boot upper is provided, in a conventional manner, with two flaps 101, 201 which define between them the longitudinal opening 301. To the said flaps there must be anchored, or anyhow secured, the lacing devices which are of the conventional type comprising a lever-like lacing member 2 provided with hook indetations 3 on one flap, (101) intended to cooperate with a ring-like lacing member 4 on the other flap 201. In order to provide to the anchoring of said lacing members 2 and 4, the flaps 101 and 201 are provided with a plurality of slide guides 5, which project outwardly of the surface of the said flaps. The slide guides 5 are arranged in confronting pairs on the flaps 101 and 201, so that a slide guide 5 of one pair (on flap 101) serves for the anchoring of lacing member 2, while the other slide guide 5 of the pair (on flap 201) serves for the anchoring of lacing member 4.

Figure 5:
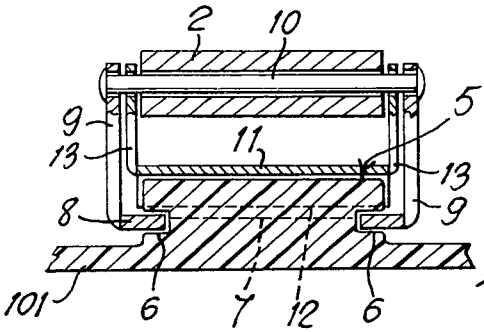
FIG. 5 is a transversal section, with parts in view, of a detail of the lacing device in the closed position of FIG. 4, taken along a transversal plane passing in correspondence of the articulation axis of the hooked lever-like lacing member.

In the embodiment shown, the slide guides 5 are made of one piece with the ski boot upper, preferably at the moment of the molding of the upper itself, and present a T-shaped profile in cross section, as it may be best appreciated from FIG. 5. The profile of said slide guides 5 defines a longitudinal side groove or guide 6 which runs along the said slide guide 5, below the enlarged head portion defined by the said T-shaped profile, on the two longitudinal sides and in correspondence of the rear side 106, the term "rear" being used to indicate a side or portion which is located farther from the longitudinal opening 301 defined by the flaps, while the term "front" will be used to indicate a side or portion which is located next to the said longitudinal opening.

Figure 2:
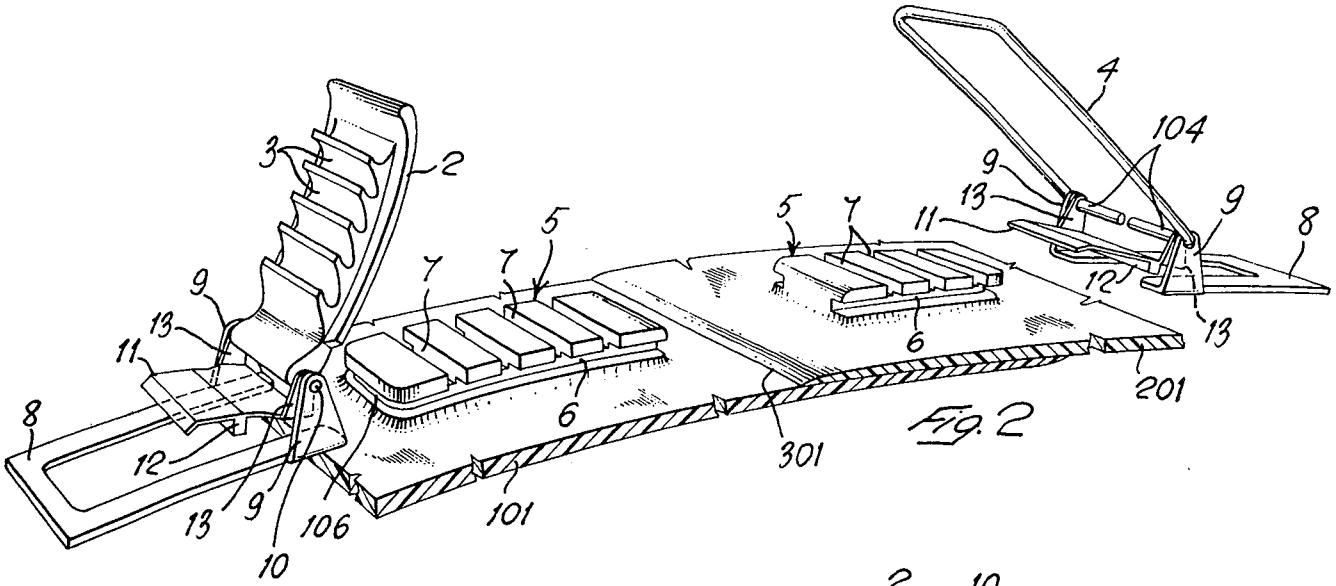
FIG. 2 is a perspective view showing an enlarged detail of the lacing device, disassembled from the ski boot.

Each slide guide 5 presents a series of transversal recesses or notches 7, having a rectangular section. Said recesses or notches 7 may be, as represented particularly in FIG. 2, in the form of transversal slits extending from one longitudinal side to the other of the guide 5, or may consist of borings obtained in the body of the slide guide. Preferably, as it clearly appears from FIG. 4, the guide groove 6, (106) is located at a level which is slightly higher that the surface of the flap.

Each lacing member 2, 4 is carried by a carrier plate 8 presenting in plan view an elongate U-shape, the sides or legs of said U-shaped plate being set at such a distance so as to be capable to slidably engage with some friction into the corresponding longitudinal grooves or guides 6 of each slide guide 5 (see also FIG. 5).

In correspondence of the free ends of the legs of U-shaped carrier plate there are provided, at each side, upwardly directed lugs 9 for accommodating, in correspondence of their top portion, a transverse pivot pin 10, 104. It is to be noted that, in the case of the lever-like lacing member 2, the pivot pin 10 which serves for hingedly connecting the said lever-like lacing member 2 to the carrier plate 8, is constructed as a separate element (see particularly FIG. 5), while in the case of the ring-like lacing member 4, the pivot pin 104 practically is obtained by the extremities of the ring-like lacing member 4 which are bent coaxially the one towards the other, as it can be fully appreciated in FIG. 2. On the pivot pin 10, 104 there is also hingedly mounted by means of lugs 13, a locking lever 11 which carries a downwardly directed locking pin or tooth 12 presenting a profile which substantially corresponds to the profile of the notch 7 of guide 5.

Figure 3:
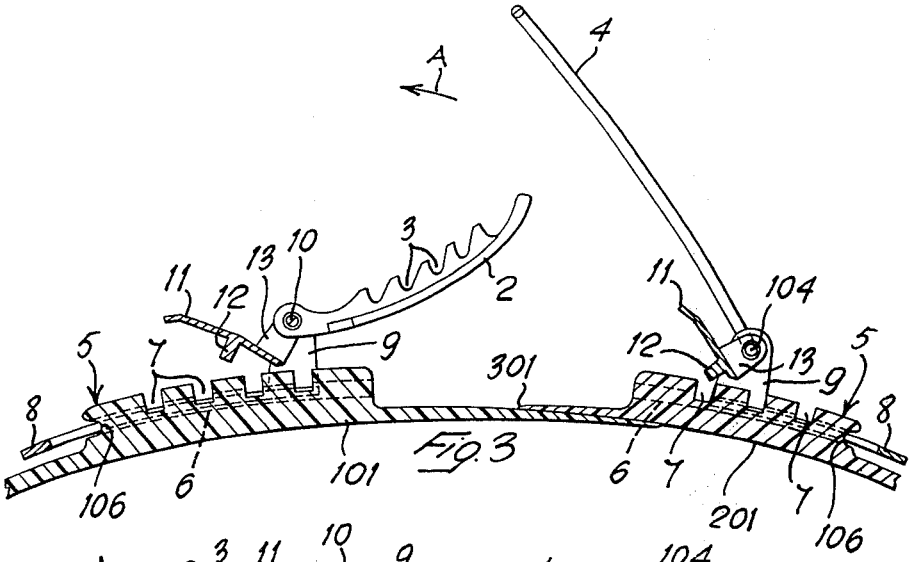
FIG. 3 is a side section of the lacing device, in open position.

It is to be noted (see particularly FIGS. 2, 3 and 4) that the locking lever 11 hingedly mounted on the carrier plate of the lever-like lacing member 2 is directed, with its free end, towards the rear of the corresponding slide guide 5, while the locking lever 11 mounted on the carrier plate which carries the ring-like lacing member 4 is directed, with its free end, towards the front of the corresponding slide guide 5.

The anchoring of the just described lacing device is simple and evident:

Each carrier plate 8 of a pair of carrier plates carrying the lever-like lacing member 2 and the ring-like lacing member 4 is fitted onto the slide guide 5, by sliding along the longitudinal grooves 6 of said slide guide 5. The carrier plate is adjusted at the distance which is suitable to the individual skier for the closure of the boot. The skier then presses down the locking lever 11 so that the tooth 12 carried by same engages a notch 7 of the slide guide 5. At this point, the carrier plate 8, and the lacing member carried by it, will be locked on the slide guide, without the possibility of sliding either towards the front or the rear of the guide itself. The skier then will close the lacing device in the usual manner by inserting the hooked lever-like lacing member into the ring-like lacing member, and by acting on the lever-like lacing member 2 in the direction of arrow A to FIG. 3, so as to bring the lacing device in the position shown in FIG. 4.

Figure 4:
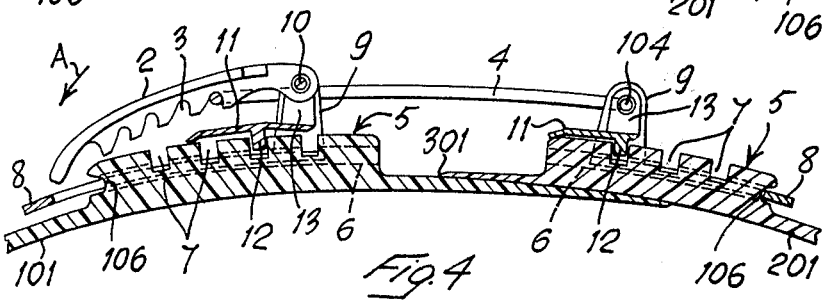
FIG. 4 is a side section of the lacing device, in closed position.

It will be noted that the lacing members 2, 4 cover, in the closed position of the lacing device, the locking levers 12 (see FIG. 4). This will avoid any accidental opening of the locking levers during the use of the ski boot. A suitable design of the lacing members 2 and 4 can in addtion contribute to the actual closure of the locking lever 11, by pressing onto it at the moment of the closure of the lacing device.

Whenever it is desired to adjust the position of one or both the members of the lacing device, it will be sufficient to lift the locking lever 11, thus disengaging tooth 12 from notch 7, and to move the carrier plate 8 along the grooves 6 of the guide slide 5, till the desired position is reached, and then again proceed to the locking in position of the carrier plate and lacing member carried by it.

Also, it is evident that either of the two members of the lacing device according to the invention can be easily removed and substituted, in case of breakage or malfunctioning of same.

It is believed that the invention will have been clearly understood from the foregoing detailed description of a preferred embodiment of same. Changes in the details of construction may be resorted to without departing from the spirit of the invention, and it is accordingly intended that no limitation be implied and that the hereto annexed claims be given the broadest interpretation to which the employed language fairly admits.

I claim:

1. In a ski boot of the type comprising a ski boot upper provided with two flaps defining an opening, a lacing device including a hooked lever-like lacing member provided on one flap and intended to cooperate with a ring-like lacing member on the other flap, anchoring means for securing at least one of said lacing members hingedly and in a removable manner onto the corresponding flap, with possibility of adjustment of the distance of the lacing member with respect to the said opening, said anchoring means comprising:

a. a slide guide element provided on the flap and presenting at least a guide arranged transversely with respect to the opening, said slide guide element presenting further at least two notches located at different distances with respect to the opening;

b. a carrier plate onto which there is hingedly mounted the lacing member, said carrier plate presenting at least a suitable engaging portion capable of slidably engaging the corresponding guide provided on the slide guide element;

c. a locking element provided on said carrier plate, and presenting at least a locking tooth or projection capable of engaging a notch located on the slide guide element.

2. A lacing device according to claim 1, in which the locking element forming part of the anchoring means consists of a locking lever, hingedly mounted on the carrier plate, and provided with a tooth capable of engaging and disengaging a notch of the slide guide element upon actuation of the locking lever itself.

3. A lacing device according to claim 2 in which the locking lever is hinged on the same hinge axis of the lacing member.

4. A lacing device according to claim 2 in which the actuation of the locking lever into its locking position is obtained through the actuation of the lacing member into its lacing position.

5. A lacing device according to claim 1 in which the slide guide element consists of a substantially rectangular body projecting out of the surface of the ski boot flap, said body being provided with a pair of guide grooves transversely directed to the opening and serving as guides, while the carrier plate consists of a substantially U-shaped plate, the sides or legs of said U-shaped plate being capable to slidably engage the grooves in the slide guide element, and being provided, in correspondence of their free ends, with orthogonally projecting portions or lugs suitable for the realization of the hinge point of the lacing member and of the locking element.

6. A lacing device according to claim 1, in which the slide guide element is obtained of one piece with the flap of the ski boot.

* * * * *